US008403235B2

(12) United States Patent
Ortiz Rivas

(10) Patent No.: US 8,403,235 B2
(45) Date of Patent: Mar. 26, 2013

(54) LEVELING RAIL JOINTS WITH PLANE SUPPORT FOR DIFFERENT PROFILE SECTIONS

(76) Inventor: Arturo A. Ortiz Rivas, Monterrey (MX)

( * ) Notice: Subject to any disclaimer, the term of this patent is extended or adjusted under 35 U.S.C. 154(b) by 164 days.

(21) Appl. No.: 12/852,024

(22) Filed: Aug. 6, 2010

(65) Prior Publication Data

US 2012/0031988 A1 Feb. 9, 2012

(51) Int. Cl.
*E01B 11/00* (2006.01)

(52) U.S. Cl. ..... 238/151

(58) Field of Classification Search ..... 238/151, 238/159–161, 243, 246–248, 336
See application file for complete search history.

(56) References Cited

U.S. PATENT DOCUMENTS

| | | | | |
|---|---|---|---|---|
| 862,645 | A | | 8/1907 | Lewis |
| 1,072,866 | A | | 9/1913 | McEvoy et al. |
| 1,089,058 | A | | 3/1914 | Keller |
| 1,201,815 | A | | 10/1916 | Forbes |
| 1,335,385 | A | | 3/1920 | Mitchell |
| 1,369,697 | A | | 2/1921 | Mulzer |
| 1,395,136 | A | | 10/1921 | Pleshe |
| 1,639,620 | A | | 8/1927 | Troup |
| 1,871,977 | A | | 8/1932 | Frickey |
| 2,161,340 | A | | 6/1939 | Disbrow |
| 2,531,656 | A | | 11/1950 | Thonger |
| 2,793,816 | A | | 5/1957 | Lansing |
| 3,199,855 | A | | 8/1965 | Miller |
| 4,386,736 | A | | 6/1983 | Benkler et al. |
| 4,466,570 | A | | 8/1984 | Howard |
| 4,630,772 | A | | 12/1986 | Watanabe et al. |
| 4,922,743 | A | * | 5/1990 | Hillegass et al. ..... 72/377 |
| 5,456,430 | A | | 10/1995 | Ortiz Rivas |
| 5,503,331 | A | | 4/1996 | Uramson, Jr. et al. |
| 5,765,785 | A | | 6/1998 | Ortiz Rivas |
| 6,119,988 | A | | 9/2000 | Ortiz Rivas |
| 6,254,038 | B1 | | 7/2001 | Ortiz Rivas |
| 6,276,643 | B1 | | 8/2001 | Ortiz Rivas |
| 2009/0302125 | A1 | | 12/2009 | Urmson, Jr. et al. |
| 2010/0090018 | A1 | | 4/2010 | Akhtar et al. |

OTHER PUBLICATIONS

American Railway Engineering and Maintenance of Way Association, Identification of: Compromise Joints, Compromise Rails—Plan 700B-10, Jan. 1934.

American Railway Engineering and Maintenance of Way Association, Identification of: Compromise Joints, Compromise Rails—Plan 700B-42, Jan. 1942.

* cited by examiner

*Primary Examiner* — Robert McCarry, Jr.
(74) *Attorney, Agent, or Firm* — Bracewell & Giuliani LLP

(57) ABSTRACT

A leveling joint between connected ends of two rails of different profiles is provided with a connector/juncture bar members which is configured to fit with and engage corresponding surfaces formed on the rails when the rails are connected together. The leveling joint so formed is one with increased strength, with ease and accuracy of alignment during assembly. The leveling joint is formed of several structural members, yet functions as and affords the strength and stability of a solid, unitary assembly.

10 Claims, 7 Drawing Sheets

LEVELING RAIL JOINTS WITH PLANE SUPPORT FOR DIFFERENT PROFILE SECTIONS

CROSS REFERENCE TO RELATED APPLICATION

The present application is related to my co-pending U.S. Patent Applications entitled "Leveling Rail Joints With Oblique Support", filed of even date herewith, Ser. No. 12/852,006, and "Leveling Rail Joints With Plane Support For Different Height Rails", filed of even date herewith, U.S. patent application Ser. No. 12/852,065.

BACKGROUND OF THE INVENTION

1. Field of the Invention

The present invention relates to rail joints for the connection of two rails with different profile sections.

2. Description of the Related Art

A railroad way is formed by joining two sets of parallel rails together, each set of rails formed of a number of rails connected lengthwise at their adjoining aligned ends. When one of the installed rails required replacement due to breakage, damage or completion of useful service life, the old installed rail has been replaced with a replacement or substitute rail, which could be a new or a used rail. In such cases, the replacement or substitute rail has often been a different profile than that of the connecting rail to which connection was made. Rail joints have been used to maintain adjoining ends of rails in place when the rails have differing characteristics, such as different height, weight or profile. The profile of a rail is its shape in vertical cross-section, perpendicular to its longitudinal or length dimension. Rail joints have been provided in an attempt to compensate for transitions between adjoining rail ends with different profiles, but problems have remained.

So far as is known, the webs and heads of existing track at the rail ends were formed with curved surfaces, and the joints had generally flat surfaces except at surfaces formed on upper and lower edge portions. However, problems have been found to occur. Due to the rolling process of forming rails, there were minor variations in the various angles and ratios at the rail ends as well as elsewhere along their length. The dimensions and slope of the central flat portion of the web, and the curved surfaces below the head portion and the base, as well as their relative spacing, usually had minor variations between different rails, even if of the same nominal size. Similarly, the existing joints typically also had variation in dimensions and shape, even if of the same nominal size and height.

It was thus difficult to achieve a proper match and engagement between the rail ends and joints when replacement rails were being installed. In situations where a properly fitted match between the contact surfaces of the rails and the joint was not achieved, the assembled structure often exhibited less relative strength, and the assembled structure had a reduced service life.

SUMMARY OF THE INVENTION

Briefly, the present invention provides new and improved rail track structure formed at adjoining end portions of rails which have differing profiles. The rail track structure includes a first track segment and a second segment having a web portion, a base portion and a head portion. The first and second track segments differ in profile according to differences in the dimensions of one or more features of their vertical cross-section. Examples are differences in the height or width of the head portion, the height or width of the web portion or some other feature or characteristic of their vertical cross-section. The web portions of the first and second track segments have a number of connector holes formed therein for the passage of connectors at their end portions. The head portions of the first and second track segments have horizontal flat surfaces formed on their lower portions. The base portions of the first and second track segment has horizontal flat surfaces formed on their upper portions.

The rail track structure also includes a new and improved leveling joint according to the present invention. The leveling joint according to the present invention is in the form of an elongate joint body to span the adjoining end portions of the rails to be joined. The joint body has a number of connector holes formed in it which are aligned with connector holes in web portions of the adjoining end portions of the rails to be joined. The joint body also includes an engaging shoulder member extending inwardly along its length towards the web of the rails. The engaging member also has a number of connector holes formed through it which are aligned with the connector holes in the joint body and the connector holes in web portions of the adjoining end portions of the rails. The engaging shoulder member has an inwardly extending beam portion with a vertical contact surface for engaging corresponding flat vertical surfaces on the web portions of the adjoining end portions of the rails. The joint body is located outwardly of the engaging shoulder member and is adapted to be fitted between head and base portions of the adjoining end portions of the rails being joined. The joint body has a downwardly extending contact rib member formed along its length. The contact rib member having a horizontal contact surface formed on it for engaging with a corresponding horizontal flat surface formed on a sloped surface of base portions the adjoining end portions of the rails to be joined.

The present invention provides new and improved leveling rail joints where the fitting, engagement and engagement with the rails being connected at their end portions is made by a set of joint or connector bodies that provide increased strength to the assembly. The contact areas of the connector bodies of the joint have cornered and flat surfaces both vertical and horizontal that abut with and engage corresponding surfaces the profile of rails machined according to U.S. Pat. Nos. 6,119,988; 6,254,038; and 6,276,644, of which Applicant is inventor. The subject matter of these patents is herein expressly incorporated by reference.

BRIEF DESCRIPTION OF THE DRAWINGS

The characteristic details of the present invention are clearly shown in the following description and accompany figures, which illustrate this and provide points of reference to indicate the same parts in the figures shown.

DETAILED DESCRIPTION OF THE PREFERRED EMBODIMENTS

Figure 6:
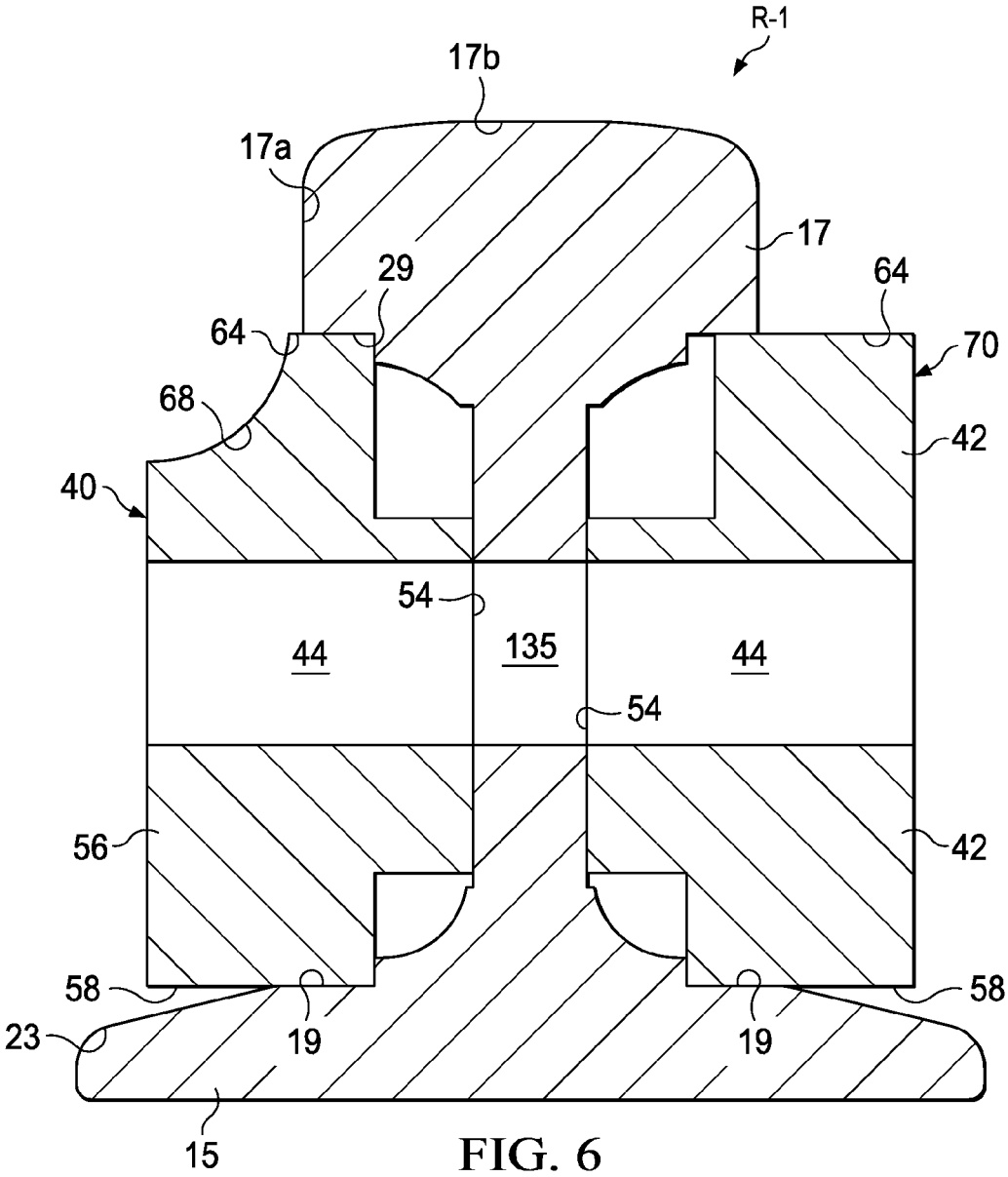
FIG. 6 is a cross-sectional view taken along the lines 6-6 of FIG. 2.

In the drawings, the letter S designates generally a railroad track structure formed by a leveling rail joint L between a pair of adjacent track components, such as rail sections or segments R (FIGS. 1 and 2) and R-1 (FIGS. 1 and 6) whose end portions E are to be joined. The rails R are at their end portions E of the type disclosed in Applicant's U.S. Pat. Nos. 6,119,988; 6,254,038 and 6,276,243, each of which is incorporated herein by reference. As will be set forth below, the adjoining end portions E of rails R and R-1 which are joined by the leveling rail joint L have differing profiles. The first and second track segments differ in profile according to differences in the dimensions of one or more features of their vertical cross-section. Examples are differences in the height or width of the head portion, the height or width of the web portion, or some other feature or characteristic of their vertical cross-section. The differences may be the result of one of the rails, such as the rail R-1 having become smaller as a result of a period of service usage, or of different design profile, or for other reasons.

Figure 3:
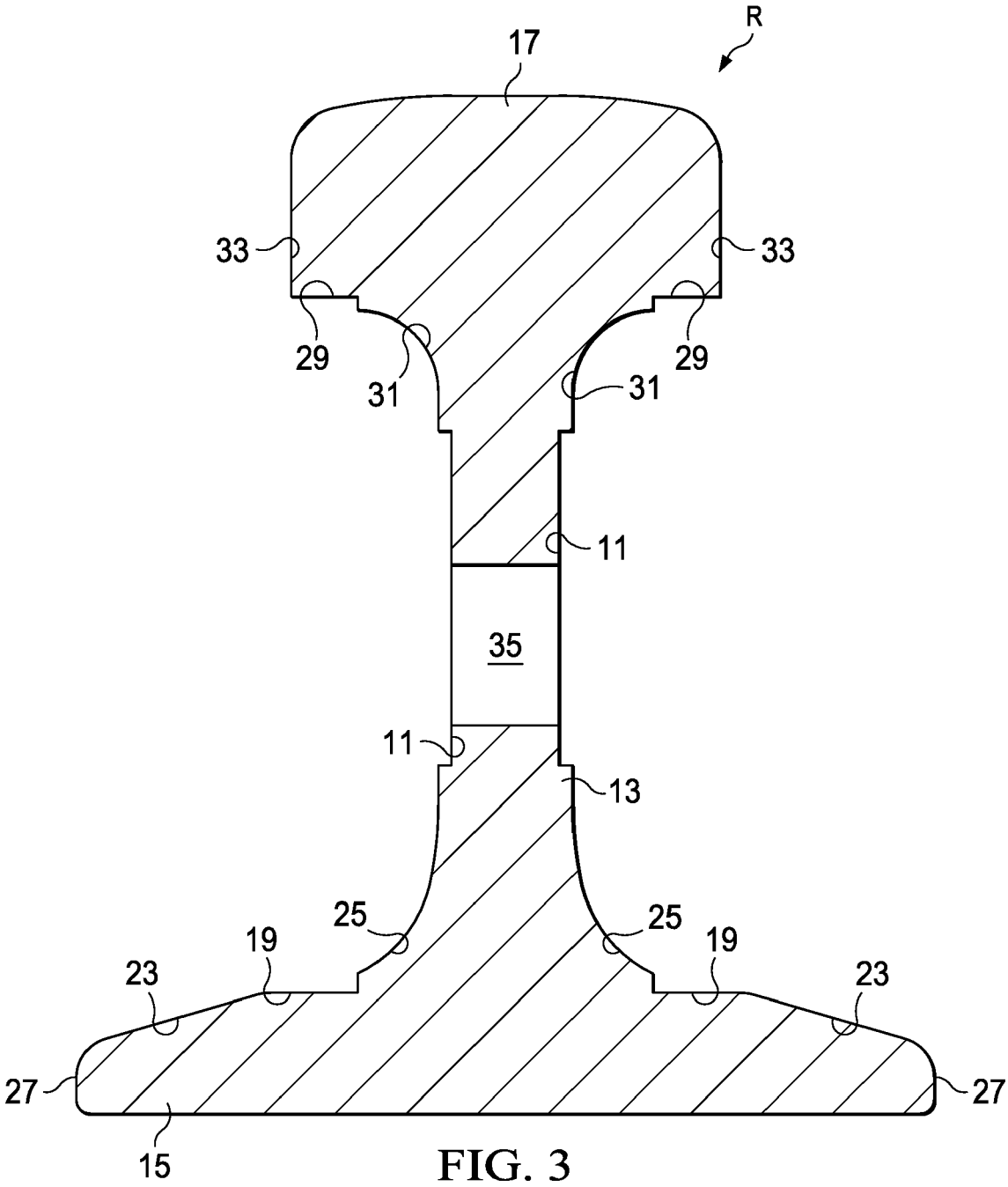
FIGS. 3, 4 and 5 are vertical cross-sectional view of components of the structure of FIG. 2.
Figure 7:
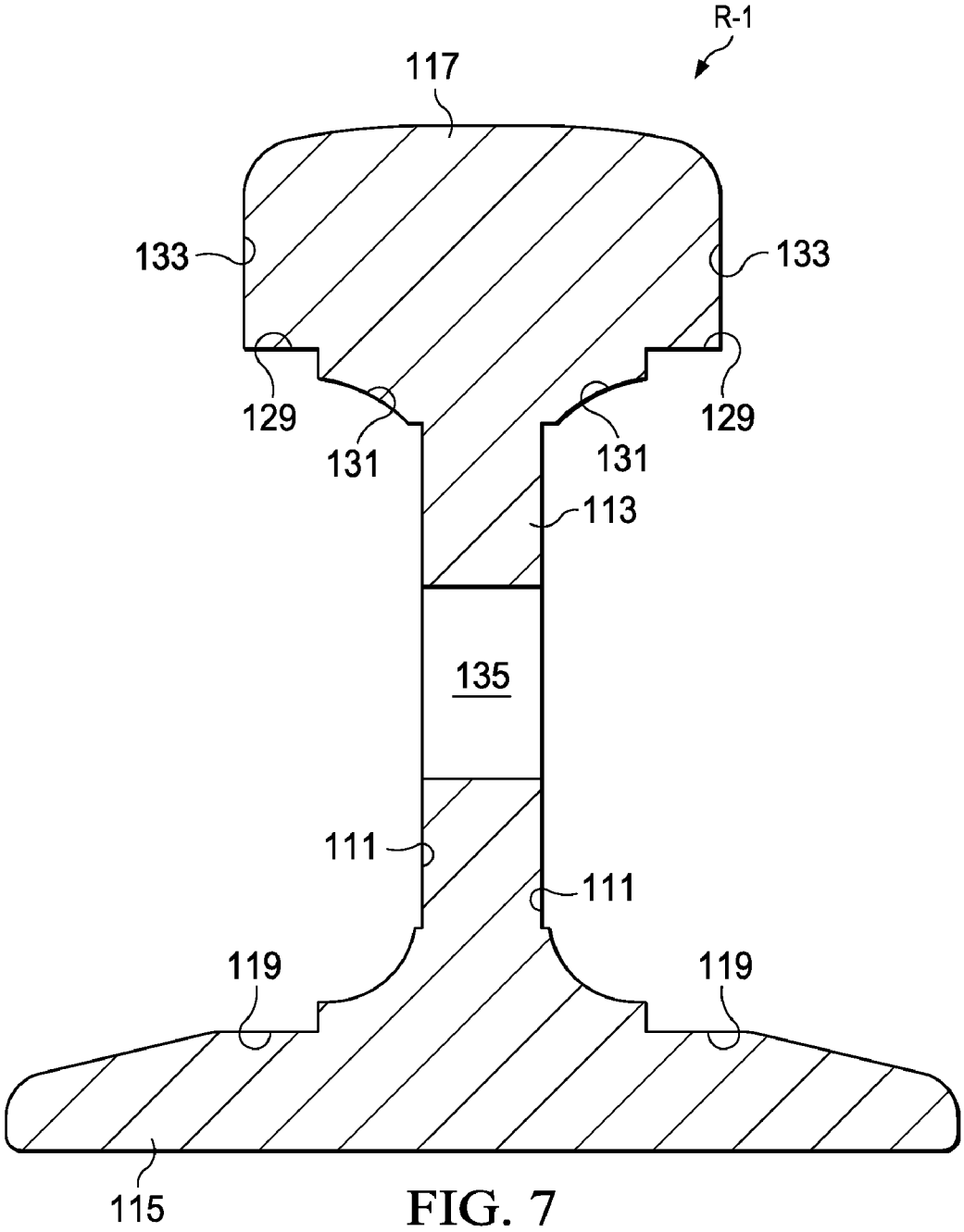
FIGS. 7, 8 and 9 are vertical cross-sectional view of components of the structure of FIG. 6.
Figure 8:
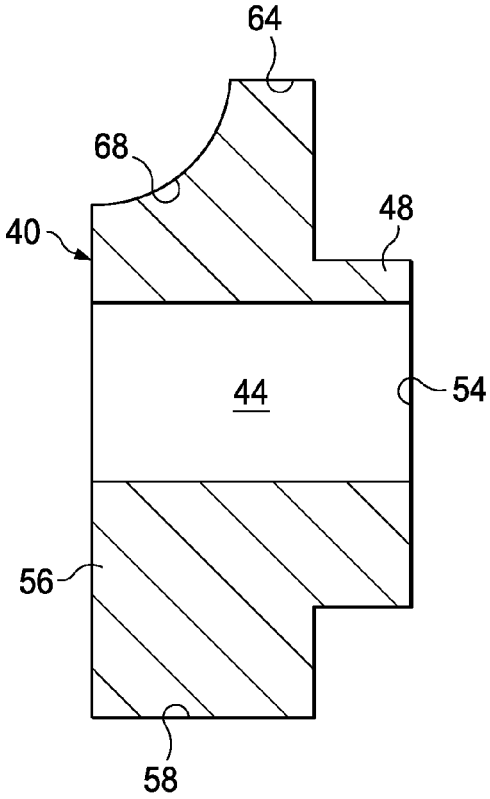
Figure 9:
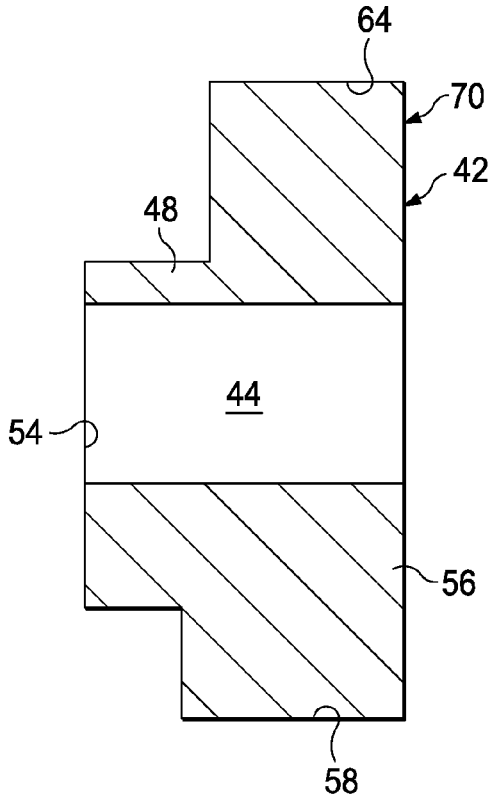

Turning first to the rail R, the end portion E of the rail R to be joined has different profile characteristics, in this case a different height and a larger head portion, from the rail R-1 as can be seen by comparing FIG. 3 and FIG. 7. The rail R has a flat vertical surface 11 formed on each side of a web portion 13 between a foot or base portion 15 and a head portion 17. The flat vertical surfaces 11 on the rail web 13 are formed in the manner disclosed in Applicant's previously mentioned U.S. Pat. Nos. 6,119,988; 6,254,038 and 6,276,243, and Applicant's U.S. Pat. No. 5,765,785, which is also incorporated herein by reference. The vertical flat surfaces 11 serve as precise measurement and alignment references for other surfaces formed on the rails R and other components of the structure S, as will be set forth below.

The rail R (FIG. 3) also includes a horizontal flat surface 19 formed on an intermediate area 21 of each outwardly sloped upper surface 23 of the base portion 15. The flat horizontal surfaces 19 are formed at a location between a lower radius area 25 of the web portion 13 and an outer edge 27 of a lower side of the base portion of the rail end portion E. The flat surfaces 19 are formed in a common horizontal plane which is perpendicular within the accuracy of precision machining tolerances to the vertical plane in which the flat vertical surface 11 of the web portion 13 is formed.

The rail R also includes a horizontal flat surface 29 formed on each lower inwardly curving surface or radius 31 beneath the head portion 17. The flat surfaces 29 are formed extending inwardly from a side edge portion 33 at its juncture with the inwardly curving surface 31 below the head portion 17. The flat surfaces 29 of the head portion 17 are formed in a common horizontal plane as shown.

The horizontal plane of each flat surface 29 is perpendicular within the accuracy of machining tolerances to the vertical plane in which the flat surface 11 of the web portion 13 is formed. The horizontal plane of flat surfaces 29 is thus parallel within the accuracy of machining tolerances to the horizontal plane of the flat surface 19 in the base portion 15. The web portions 13 of the rails R have a suitable number of connector ports or holes 35 spaced along the longitudinal extent of the end portions E for passage of connector bolts or other suitable fastener mechanisms.

In a corresponding manner, the rail R-1 (FIG. 7) has a flat vertical surface 111 formed on each side of a web portion 113 between a foot or base portion 115 and a head portion 117. The flat vertical surfaces 111 on the rail web 113 are formed in the manner disclosed in Applicant's previously mentioned U.S. Pat. Nos. 6,119,988; 6,254,038 and 6,276,243, and Applicant's U.S. Pat. No. 5,765,785. The vertical flat surfaces 111 serve as precise measurement and alignment references for other surfaces formed on the rails R and other components of the structure S, as will be set forth below.

The rail R-1 also includes a horizontal flat surface 119 formed on an intermediate area 121 of each outwardly sloped upper surface 123 of the base portion 115. The horizontal flat surfaces 119 are formed at a location between a lower radius area 125 of the web portion 113 and an outer edge 127 of a lower side of the base portion 115 of the rail end portion E. The flat surfaces 119 are formed in a common horizontal plane which is perpendicular within the accuracy of precision machining tolerances to the vertical plane in which the flat vertical surface 111 of the web portion 113 is formed.

The rail R also includes a horizontal flat surface 129 formed on each lower inwardly curving surface or radius 131 beneath the head portion 117. The flat surfaces 129 are formed extending inwardly from a side edge portion 133 at its juncture with the inwardly curving surface 131 below the head portion 117. The flat surfaces 129 of the head portion 117 are formed in a common horizontal plane as shown.

The horizontal plane of each flat surface 129 is perpendicular within the accuracy of machining tolerances to the vertical plane in which the flat surface 111 of the web portion 113 is formed. The horizontal plane of flat surfaces 129 is thus parallel within the accuracy of machining tolerances to the horizontal plane of the flat surface 119 in the base portion 115. The web portions 113 of the rails R-1 have a suitable number of connector ports or holes 135 spaced along the longitudinal extent of the end portions E for passage of connector bolts or other suitable fastener mechanisms.

The leveling rail joint L according to the present invention is in the form of an elongate joint body 40 adapted to be mounted along and span the gage or inwardly facing sides of the adjoining end portions E of the rails R to be joined. The joint body 40 can be regarded as a gage joint bar located on the inner side of the rails R and R-1 where the flanges of rolling stock wheels are located. The leveling joint L also includes an elongate leveling joint body or bar member 42 located on an outer side of the rails R and R-1. Joint body 42 is adapted to be mounted along and span the outwardly facing sides of the adjoining end portions E of the rails R to be joined. The length of the joint bodies 40 and 42 and their extent along the adjoining end portions E with which they are mounted are determined by the intended service or usage nature of the rails R and load bearing considerations.

The joint bodies 40 and 42 are formed of suitable strength alloy steel, depending upon the intended load and service usages of the rail structure S. Alloy steel bars are machined with cornered and flat surfaces, as will be described to form the joint bodies 40 and 42. The joint bodies 40 and 42 are elongate in the context of being of adequate extent along the rail joint between the rails R and R-1 to provide adequate strength, support and durability during service life usage. This is determined by rail dimensions, and also intended service or usage nature of the rails, load bearing considerations and other rail design factors. As will be set forth, the vertical height and lateral cross-sectional thickness of the joint bodies along their extent is determined by the dimensions on the rails R and R-1 being joined.

The joint bodies 40 and 42 have a suitable number of connector holes or ports 44 formed in each of them along their longitudinal extent. The connector holes 44 are spaced from each other along the joint bodies 40 and 42 at locations aligned with the connector holes 35 and 135 in web portions 13 and 113, respectively, of the adjoining end portions E of the rails R and R-1 to be joined. The connector holes or passages 44 allow bolts and other suitable connecting mechanisms to be inserted to connect these components of the composite rail joint L with each other.

The joint body 40 includes an engaging shoulder member 48 extending inwardly along the length of body 40 towards the web section 13 of the rail end portions E. The engaging shoulder member 48 of the inner joint body 40 has an inner side lateral leveling jut vertical contact surface 54 for engaging corresponding flat vertical surfaces 11 on the gage or inwardly facing web portions 13 and 113 of the adjoining rail end portions E. The joint body 40 is located outwardly of the engaging shoulder member 48 and is adapted to be fitted between head portion 17 and base portion 15 of the adjoining rail end portions E. The joint body 40 has a downwardly extending contact rib member 56 formed along its length. The contact rib member 56 has a horizontal contact surface 58 formed on it for engaging with a corresponding horizontal flat surface 19 formed on the sloped upper surface 23 of base portions 15 of the adjoining rail end portions E to be joined by the leveling rail joint L.

The horizontal contact surface 58 formed on contact rib member 56 is perpendicular to the lateral leveling contact surface 54 on the shoulder member 48 within the limits of machine tolerance accuracies. The spacing of the horizontal surface 58 from the vertical surface 54 on the joint body 40 conforms to the spacing of the surfaces 19 and 11, respectively, on the rail end portions E of the rails R and R-1. In this way, when the vertical surfaces 54 and 11 are in proper engagement, the horizontal surfaces 58 and 19 are also firmly in contact and aligned in proper engagement.

The joint body 40 also has an upwardly extending contact rib member 62 formed on an upper surface of the joint body 40 along the extent of length spanning the end sections E. The upper contact rib member 62 has an inner side upper leveling shoulder surface 64 formed thereon for engaging a corresponding horizontal flat surface 29 below the head portions 17 of the rail ends E to be joined. The horizontal flat upper contact surfaces 29 below the head portions 17 of the rails R are formed extending inwardly from a side surface 17*a* of the head portions 17.

The inner side upper leveling shoulder surface 64 is adapted for mounting on and in engagement with horizontal flat surfaces 29 on head portions 17 of adjacent rail end portions E. The leveling shoulder surface 64 is perpendicular within the limits of machining tolerance accuracy to the inner side lateral leveling surface 54 of the shoulder member 48. The spacing of the lateral leveling surfaces 54 of the shoulder member 48 from the leveling shoulder surface 64 conforms to the spacing of the surfaces 29 and 11 formed on the adjacent rail end portions E of the rails R and R-1. The spacing of the surfaces 58 and 64 from each other on the shoulder member 48 matches that of the distance of the flat surfaces 19 and 23 in the rail end portions E.

The inner joint body 40 extends outwardly beyond the head portions 17 of the rails R to provide additional strength to the assembled leveling joint L. The joint body 40 has an arcuate or curved surface 68 extending downwardly from the leveling shoulder surface 64. The surface 68 is formed below and inside of the lateral extent of the head portion 17 of the rail R. The surface 68 provides a flange way or clearance to accommodate the outer portion of wheel flanges of rail rolling stock which extend downwardly below the head portions 17.

The outer joint body 42 is of like construction to the joint body 40, and thus like reference numerals are used for like structural features. In the outer joint body 42, no accurate surface for wheel flange passage is provided. Rather, a support segment 70 of rectangular shape is located in an upper area outside of the lateral extent of the head portion 17.

The joint bodies 40 and 42 shown in the embodiment illustrated in the drawings are thus made and designed so that their dimensions are configured to be installed on rails R at end portions E. The joint bodies 40 and 42 thus form a composite joint where the rail R differs in profile from rail R-1 in both height and the size of the head portions 17, as is evident from the drawings. In the joint body 40 the heights and relative spacing of the engaging shoulder member 48, body portion 52, rib members 56 and 62 and the contact surfaces formed thereon are different on either side of a midpoint (as indicated by a vertical line 72) to conform to the transitions in dimensions between the height and relative position of the surfaces 11, 17, and 29 of the inner side of the rails R and R-1. The component heights and relative spacing of the outer joint body 42 correspond and conform to the dimensions and location of the corresponding surfaces formed on the outer sides of the rails R-1.

Figure 1:
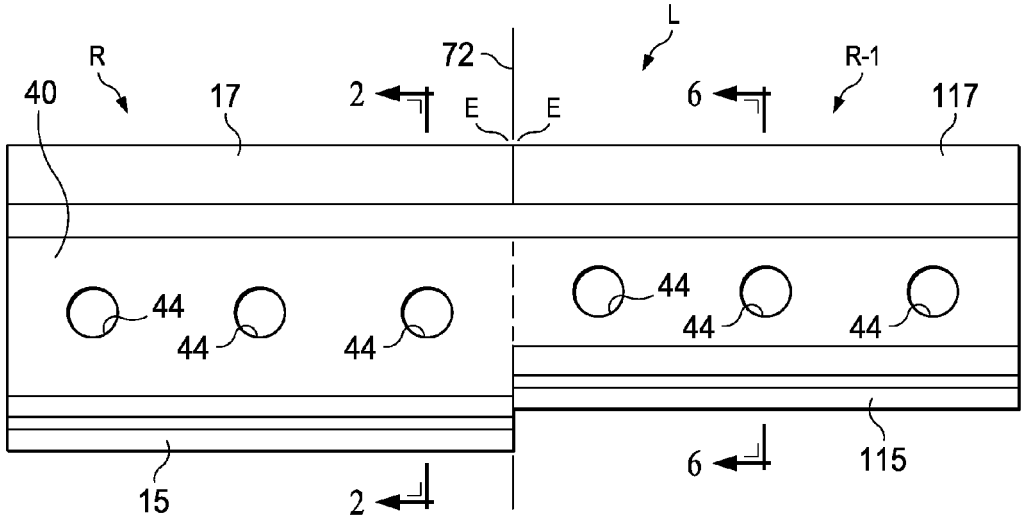
FIG. 1 is a side view of a leveling rail joint according to the present invention for joining rails of different profiles.
Figure 2:
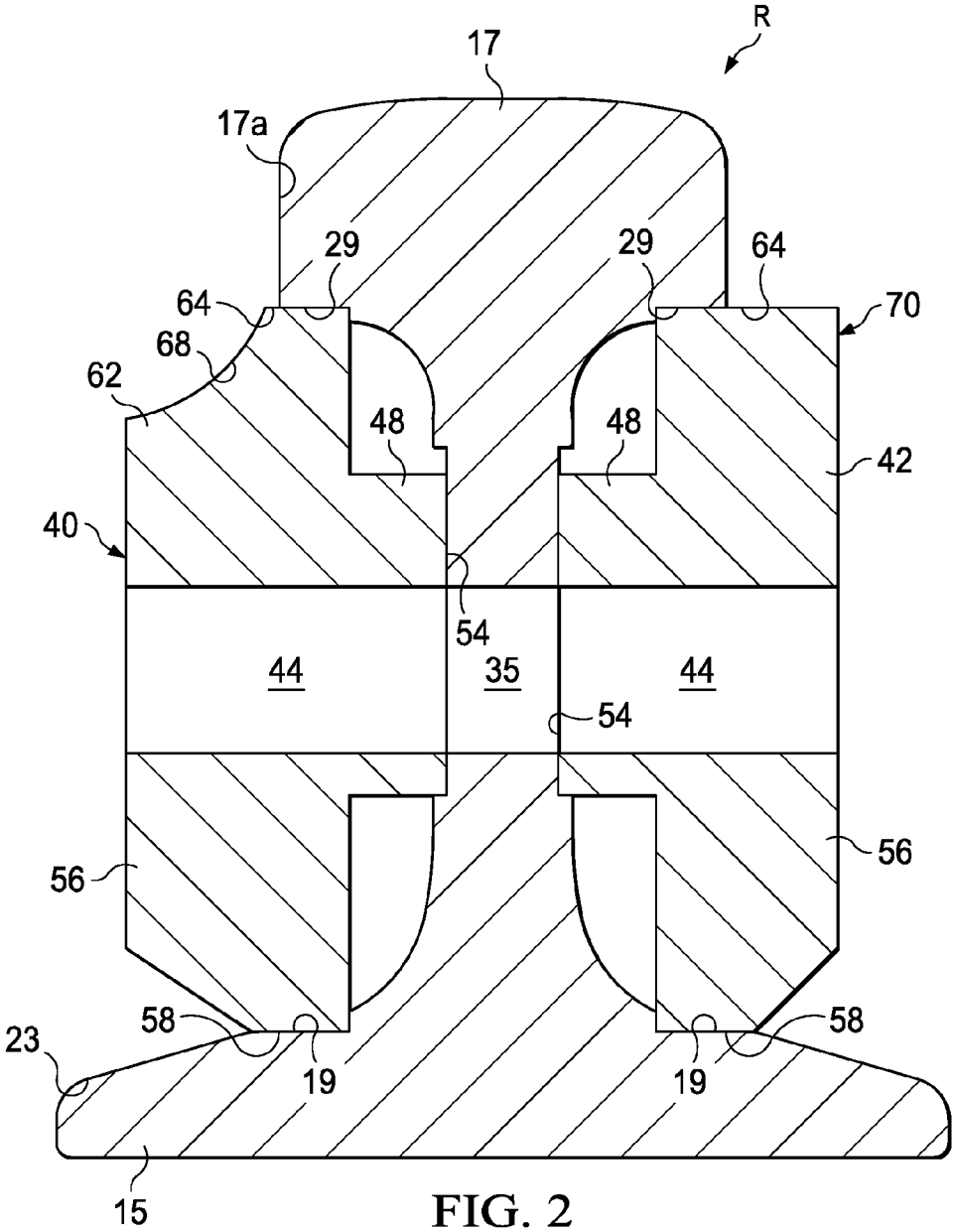
FIG. 2 is a cross-sectional view taken along the lines 2-2 of FIG. 1.

Leveling rail joints according to the present invention are manufactured according to the differences in height, profile or dimensions of the rails R and R-1 to be joined. The leveling rail joint thus has a difference in height between surfaces 64 and 58 on each such side based on the difference in height between the rails R and R-1. In cases where there is no difference in height, the surfaces 64 and 58 are equally spaced along the full length of the rail joint. More typically, as shown in FIG. 1, where one of the rails such as R-1 is shorter in height than the rail R, the surfaces 64 and 58 are spaced to compensate for the height difference between the rails being joined. Thus upper surfaces 17*b* over which rolling stock wheels ride are in a common, level horizontal plane. This provides an even and level surface for bearing the load of rolling stock as the wheels travel over the rails R and R-1 at their juncture.

Further, when the rails R and R-1 are different in either the width of the head portions or the web portions 11, or both, the leveling rail joints 42 are manufactured so that the inward extent of the shoulder members 48 is different for those portions mounted to engage the two rails. The amount of the difference in inward extent of the shoulder members 48 corresponds to the differences in width between the rails R and R-1. In this manner, the inner surfaces 17*a* of rails R and R-1 which are in contact with wheel flanges are aligned in a common vertical plane. The aligned inner surfaces 17*a* present a smooth vertical surface for contact by the wheel flanges passing through the rail joint formed according to the present invention.

The rail joints formed according to the present invention provide planar support due to horizontal alignment in the horizontal plane along the upper surfaces 17*b* engaged by rolling stock wheels and vertical alignment in the vertical plane along inner surfaces 17*a* which are in contact with the wheel flanges.

The component heights and relative spacing of the outer joint body 42 corresponds and conforms to the dimensions and location of the corresponding surfaces formed on the outer sides of the rails R and R-1. It is usually the practice to position a load bearing plate member or shim beneath the foot or base portion 15 of the shorter rail for load transfer purposes.

Further, when the rails R and R-1 are different in either the width of the head portions 15 or the web portions 11, or both, the leveling rail joints 42 are manufactured so that the inward extent of the shoulder members 48 is different for those options mounted to engage the two rails. The amount of the difference in inward extent of the shoulder members 48 corresponds to the differences in the width between the rails R and R-1. In this manner, the inner surfaces 17*a* of rails R and R-1 which are in contact with wheel flanges are aligned in a common vertical plane. The inner surfaces 17*a* present a smooth vertical surface for contact by the wheel flanges passing through the rail joint forward according to the present invention. The rail joints formed according to the present invention are thus in horizontal alignment along the upper surfaces 17*b* engaged by rolling stock wheels and in vertical alignments along inner surfaces 17*a* which are in contact with the wheel flanges.

When the lateral leveling surfaces 54 on the shoulder member 48 are brought into contact with the vertical flat surfaces 11 on each side of the rails R and R-1, and are in proper engagement, the horizontal flat surface 58 and 64 of the joint bodies 40 and 42 are fittingly engaged with the horizontal contact surfaces 19 and 27, respectively, of the rail end portions E. The components of the leveling rail joint L and the assembled rail structure S are thus in proper, load bearing and load transfer fitting engagement.

Figure 10:
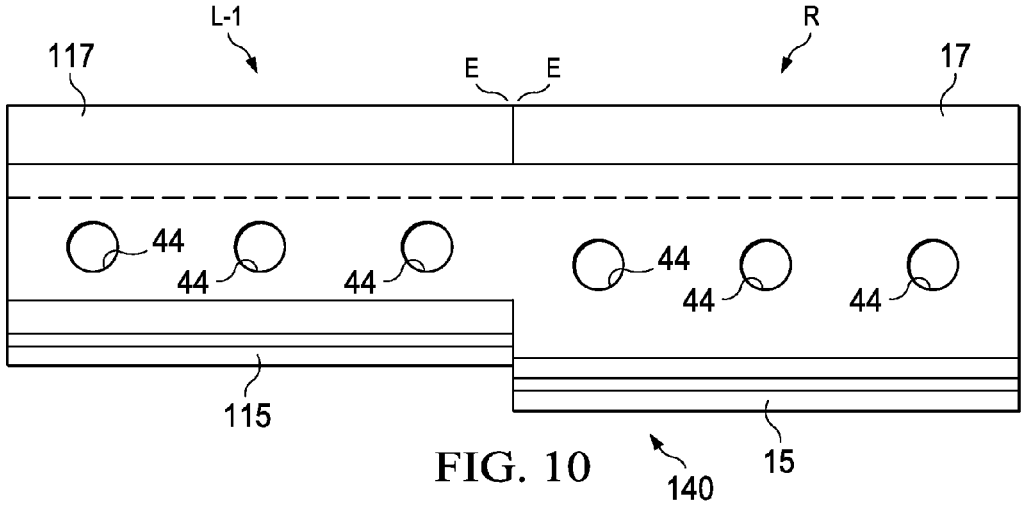
FIG. 10 is a side view of another leveling rail joint according to the present invention between adjacent end portions of rails of different profiles.

In an alternate joint L-1 (FIG. 10), a second set, composed of a joint body 140 and mating opposed joint body, is provided to be installed on a second set of rail end joint portions in the track running spaced alongside and parallel with the rails R and R-1 to form a track pair. The joint bodies of the alternate joint L-1 are like the joint bodies 40 and 42 manufactured so that their dimensions compensate for the differences in height, width or otherwise in profile of the second set of rails being joined to be laid in parallel to the rails R and R-1. Thus in the inner joint body 140 the heights and relative spacing of the engaging shoulder member, body portion, and rib members, and the contact surfaces formed thereon conform to the transitions in dimensions between the of the rail end portions.

Accordingly, the dimensions and relative spacing of structural features of joint body 140 conform to the transitions in dimensions between the height of the inner side of the rail end portions E. In vertical cross-section the joint bodies 40 and 140 are in effect mirror images of each other. The same is the case for the outer joint body 42 and its counterpart.

Figure 4:
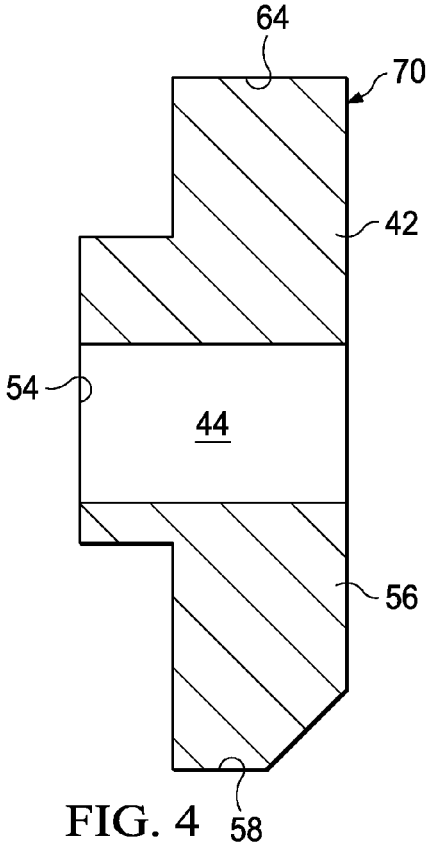
Figure 5:
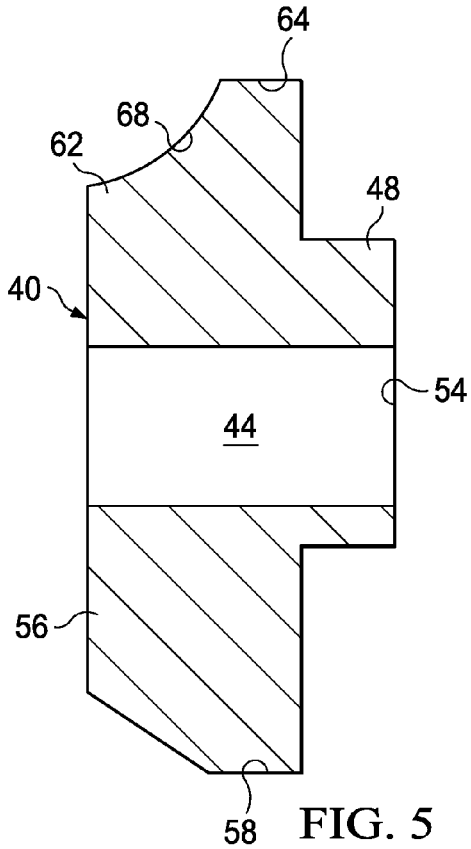

The joint bodies 40 and 140 are thus comparable construction, with their relative position in their longitudinal extent along the rails R reversed. The contact surfaces 54 of the inner joint bodies 40 and 140 thus face inwardly in the assembled leveling joint L, as shown in FIGS. 3 and 4, to engage corresponding outwardly facing vertical surfaces 11 of rail end portions E (FIG. 1).

The leveling rail joints according to the present invention achieve increased strength in the assembled structure. The assembled joint bodies in place on the rail ends form a solid unitary structure. This structure functions is achieved as an assembly of several engaged pieces with their aligned contacting surfaces. However, should the need arise, one of the structural components of the leveling rail joint can be readily changed in a short time for maintenance or replacement.

The leveling rail joints in accordance with the present invention enhance the strength of the rail and joint since the matching and engagement of the joint bodies with the corresponding surfaces on the rail ends cause the joint bodies to function in effect as two additional webs to the rail.

The leveling rail joints of the present invention provide accuracy in the vertical dimensions so that the heads of both rails have the same level at the upper part of the rail heads, making passage of the train wheels relatively noise free and without impact due to a change in height at the rail joint. The leveling rail joints also provide accuracy in the horizontal dimensions so that the connector bolts when installed compress the structural components of the joint with increased strength comparable to that of a solid, unitary piece. With the leveling rail joints of the present invention, gaps between the rails are not formed, so that impact on or movement of rails on passage of wheels is significantly diminished. This in turn affords fewer maintenance needs, safer operation and cost savings.

Having described the invention above, various modifications of the techniques, procedures, material and equipment will be apparent to those in the art. It is intended that all such variations within the scope and spirit of the appended be embraced thereby.

What is claimed is:

1. A leveling joint connector bar for connecting adjoining end portions of rails in a track structure having different profiles, the end portions of the rails being connected having vertical flat surfaces formed on their respective web portions and further having horizontal flat surfaces formed on sloped upper surfaces of their base portions, the leveling joint connector bar comprising:

an elongate joint body to span the adjoining end portions of the rails to be joined and having a number of connector holes formed therein aligned with connector holes in web portions of the adjoining end portions of the rails to be joined;

an engaging shoulder member formed with and extending along the length of the joint body, the engaging shoulder member having a number of connector holes formed therein aligned with the connector holes in the joint body and the connector holes in web portions of the adjoining end portions of the rails to be joined;

the engaging shoulder member having an inwardly extending portion having a flat vertical contact surface thereon for engaging the flat vertical surfaces formed on the web portions of the adjoining end portions of the rails to be joined;

the joint body being located outwardly of engaging shoulder member and adapted to be fitted between the head and base portions of the adjoining end portions of the rails to be joined;

the joint body having a downwardly extending contact rib member formed along its length;

the contact rib member having a horizontal contact surface formed thereon for engaging with the corresponding horizontal flat surfaces formed on the sloped surface of a base portion of the adjoining end portions of the rails to be joined.

2. The leveling joint connector bar of claim 1 wherein the adjoining end portions of the rails to be joined are different in width in their head portions and wherein the joint body is of a with conforming to the different widths of the adjoining end portions of the rails to be joined.

3. The leveling joint connector bar of claim 2, further comprising the adjoining end portions of the rails being of different height between the head and base portions.

4. The leveling joint connector bar of claim 3, wherein the joint body is of a height along of its longitudinal extent conforming to different heights of the adjoining end portions of the rails to be joined.

5. The leveling joint connector bar of claim 1, wherein the horizontal flat surface on the rail base portion is formed at a location between an outer edge of base portions and the webs of the adjoining end portions of the rails.

6. The leveling joint connector bar of claim 1, wherein the end portions of the rails being connected further have horizontal flat surfaces formed beneath their head portions and further including:

an upper contact rib formed on an upper surface of the joint body extending along its length, the upper contact rib having a horizontal upper contact surface thereon for engaging the horizontal flat surfaces below the head portions of the rails to be joined.

7. The leveling joint connector bar of claim 6, wherein the horizontal flat surface below the head portions of the rail are formed extending inwardly from side surfaces of the head portions of the adjoining end portions of the rails to be joined.

8. The leveling joint connector bar of claim 1, wherein the joint body has a support segment around the central port and extending outwardly beyond the head portions of the rails to provide additional strength to the assembled leveling joint.

9. A rail track structure formed at adjoining end portions of rails have differing rail profiles, comprising:

a first track segment and a second track segment, each having a web portion, a base portion and a head portion, the first and second track segments having differing rail profiles;

the web portions of the first and second track segments having vertical flat surfaces formed thereon;

the web portions further having a number of connector holes formed therein for the passage of connectors at their end portions;

the head portions of the first and second track segments having horizontal flat surfaces formed on lower portions thereof;

the base portion of the first track segment having horizontal flat surfaces formed on sloped upper portions thereof;

an elongate connector bar to span the adjoining end portions of the first and second track segments to be joined and having a number of connector holes formed therein aligned with connector holes in web portions of the adjoining end portions of the first and second track segments to be joined;

an engaging shoulder member extending along the length of the connector bar, the engaging shoulder member having a number of connector holes formed therein aligned with the connector holes in the connector bar and the connector holes in web portions of the adjoining end portions of the first and second track segments to be joined;

the engaging shoulder member having an inwardly extending portion having a flat vertical contact surface thereon for engaging the flat vertical surfaces on the web portions of the adjoining end portions of the first and second track segments to be joined;

the connector bar being located outwardly of the engaging shoulder and adapted to be fitted between the head and the base portions of the adjoining end portions of the first and second track segments to be joined;

the connector bar having a downwardly extending contact rib member formed along its length; and the contact rib member having horizontal flat contact surfaces formed thereon for engaging with corresponding horizontal flat surfaces formed on sloped surfaces of base portions of the adjoining end portions of the first and second track segments to be joined.

10. The rail track structure of claim 9, wherein the elongate connector member is located on a first side of the adjoining end portions of the first and second track segments, and further including:

a second elongate connector bar to span the adjoining end portions of the first and second track segments to be joined and having a number of connector holes formed therein aligned with connector holes in the elongate connector member and the web portions of the adjoining end portions of the first and second track segments to be joined;

an engaging shoulder member extending along the length of the second connector bar, the engaging shoulder member having a number of connector holes formed therein aligned with the connector holes in the second connector bar and the connector holes in the elongate connector member and the web portions of the adjoining end portions of the first and second track segments to be joined;

the engaging shoulder member having an inwardly extending portion having a flat vertical contact surface thereon for engaging the flat vertical surfaces on the web portions of the adjoining end portions of the first and second track segments to be joined;

the second connector bar being located outwardly of the engaging shoulder and adapted to be fitted between the head and the base portions of the adjoining end portions of the first and second track segments to be joined;

the second connector bar having a downwardly extending contact rib member formed along its length; and the contact rib member of the second connector bar having horizontal contact surfaces formed thereon for engaging with corresponding horizontal flat surfaces formed on sloped surfaces of base portions of the adjoining end portions of the first and second track segments to be joined.

* * * * *